US011272764B1

(12) United States Patent
Tseng

(10) Patent No.: US 11,272,764 B1
(45) Date of Patent: Mar. 15, 2022

(54) MAGNETIC BUCKLE

(71) Applicant: Duraflex Hong Kong Limited, Hong Kong (CN)

(72) Inventor: Ming Yen Tseng, Taipei (TW)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 17/009,863

(22) Filed: Sep. 2, 2020

(51) Int. Cl.
*A44B 11/25* (2006.01)
*A44B 11/26* (2006.01)
*A44B 11/28* (2006.01)

(52) U.S. Cl.
CPC ..... *A44B 11/26* (2013.01); *A44B 11/258* (2013.01); *A44B 11/28* (2013.01); *A44D 2203/00* (2013.01)

(58) Field of Classification Search
CPC ..... A44B 11/26; A44B 11/258; A44B 11/28; A44B 11/2584; A44D 2203/00
USPC ..... 24/303
See application file for complete search history.

(56) References Cited

U.S. PATENT DOCUMENTS 5,572,887 A * 11/1996 Geswelli ..... A44C 5/2071 24/303
6,292,985 B1 9/2001 Grunberger
11,083,251 B2 8/2021 Fiedler
2004/0107547 A1* 6/2004 Chung ..... A44B 11/2584 24/303
2012/0044031 A1* 2/2012 Ninomiya ..... A44B 11/2596 335/219
2014/0277103 A1* 9/2014 Esposito ..... A44B 11/258 606/203
2015/0074954 A1* 3/2015 Pruitt ..... A44C 5/2071 24/303

(Continued)

FOREIGN PATENT DOCUMENTS

CN 1555234 A 12/2004
CN 205214395 U 5/2016
CN 205306147 U 6/2016

(Continued)

OTHER PUBLICATIONS

International Search Report and Written Opinion of the International Searching Authority in PCT/CN2021/113530, dated Nov. 24, 2021.

(Continued)

*Primary Examiner* — Jack W Lavinder
(74) *Attorney, Agent, or Firm* — Collard & Roe, P.C.

(57) ABSTRACT

A buckle assembly has two buckle portions, each having a base body with a fastening hook and a fastening recess, and a magnet connected to the interior surface. The buckle portions are configured such that placing the interior surface of one buckle portion against the interior surface of the other buckle portion causes the magnets to engage each other and the fastening hook of each buckle portion to enter the fastening recess of the other buckle portion, to lock the two buckle portions together and prevent disengagement under tension in opposing directions parallel to a longitudinal extent of the buckle assembly. There is a fastening tenon connected to the base body and extending into the fastening recess on each of the buckle portions. The fastening hooks engage a respective one of the fastening tenons as the fastening hooks enter the fastening recesses to lock the two buckle portions together.

8 Claims, 6 Drawing Sheets

(56) References Cited

U.S. PATENT DOCUMENTS

2018/0132570 A1* 5/2018 Chen ..... A41F 1/002

FOREIGN PATENT DOCUMENTS

| | | | |
|---|---|---|---|
| CN | 206612290 | U | 11/2017 |
| CN | 206852181 | U | 1/2018 |
| CN | 108495569 | A | 9/2018 |
| CN | 208176194 | U | 12/2018 |
| CN | 111264979 | A | 6/2020 |
| DE | 10 2018 121 771 | A1 | 3/2020 |
| FR | 2861553 | A1 | 5/2005 |
| WO | 03/005847 | A1 | 1/2003 |

OTHER PUBLICATIONS

International Search Report and Written Opinion of the International Searching Authority in PCT/CN2021/116962, dated Dec. 7, 2021.

* cited by examiner

MAGNETIC BUCKLE

BACKGROUND OF THE INVENTION

1. Field of the Invention

This invention relates to a magnetic buckle. In particular, the invention relates to a two-piece sliding buckle that is held in place by cooperating magnets on each of the pieces.

2. The Prior Art

Two-piece buckles are often used to connect two straps together, such as in a seat belt. Often, the buckles are locked together via a spring-loaded latching mechanism, which can be released by raising or lowering a latch, or by pressing a button.

SUMMARY OF THE INVENTION

It is an object of the invention to provide a two-piece buckle assembly that is simple to engage and disengage, and which does not require moving parts, such as springs or hinges.

This and other objects are accomplished by a buckle assembly comprising a first buckle portion comprising a base body with an exterior surface, and interior surface, a fastening hook on one longitudinal end and a fastening recess on another longitudinal end, and a magnet connected to the interior surface; and a second buckle portion comprising a base body with an exterior surface, an interior surface, a fastening hook on one longitudinal end and a fastening recess on another longitudinal end, and a magnet connected to the interior surface. The buckle portions are configured such that placing the interior surface of the first buckle portion against the interior surface of the second buckle portion causes the magnets to engage each other and the fastening hook each buckle portion to enter the fastening recess of the other buckle portion, to lock the two buckle portions together and prevent disengagement under tension in opposing directions parallel to a longitudinal extent of the buckle assembly.

There is a fastening tenon connected to the base body and extending into the fastening recess on each of the first and second buckle portions. The fastening hooks engage a respective one of the fastening tenons as the fastening hooks enter the fastening recesses to lock the two buckle portions together. Preferably the tenons each have a bevel along one side thereof, which assists with the disengagement of the parts. The buckle portions are disengaged from each other by sliding the buckle portions in opposite directions from each other, transverse to the longitudinal direction of the buckles, until the fastening tenon exits the notch in the fastening hook. The force needed to move the buckle parts to disengage them must exceed the magnetic force holding the two buckle parts together, as well as the frictional force connecting the tenon to the fastening hook.

To keep the fastening hooks and fastening tenons engaged, the fastening hooks have a notch in an end portion thereof, such that an end of each tenon engages into the notch in a corresponding one of the fastening hooks when the two buckle portions are connected together. The bevel in the tenon allows the tenon to slide more easily out of the notch when sufficient lateral force is applied to disengage the buckle portions from each other.

To assist in the disengagement of the buckle portions with respect to each other, the buckle portions are shaped so that a lateral edge of the first buckle portion extends beyond a lateral edge of the second buckle portion, and an opposite lateral edge of the second buckle portion extends beyond an opposite lateral edge of the first buckle portion, when the two buckle portions are connected together. This way, the outwardly extending edges are more easily gripped and pressed by the user to disengage the buckle portions. Furthermore, there can be a plurality of finger grips on the lateral edge of the first buckle portion and the opposite lateral edge of the second buckle portion.

Preferably, each of the first and second buckle portions have at least one strap-retaining bar connected to the base body at the end having the fastening recess to allow the buckle portions to be connected to other objects.

In one embodiment, wherein the fastening recesses extend entirely though the base bodies of the first and second buckle portions, so that the fastening tenons are visible from the exterior surfaces of each of the first and second buckle portions, and when the buckle portions are locked to each other, the bottom of the fastening hook of one buckle portion is visible through the recess of the other buckle portion.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
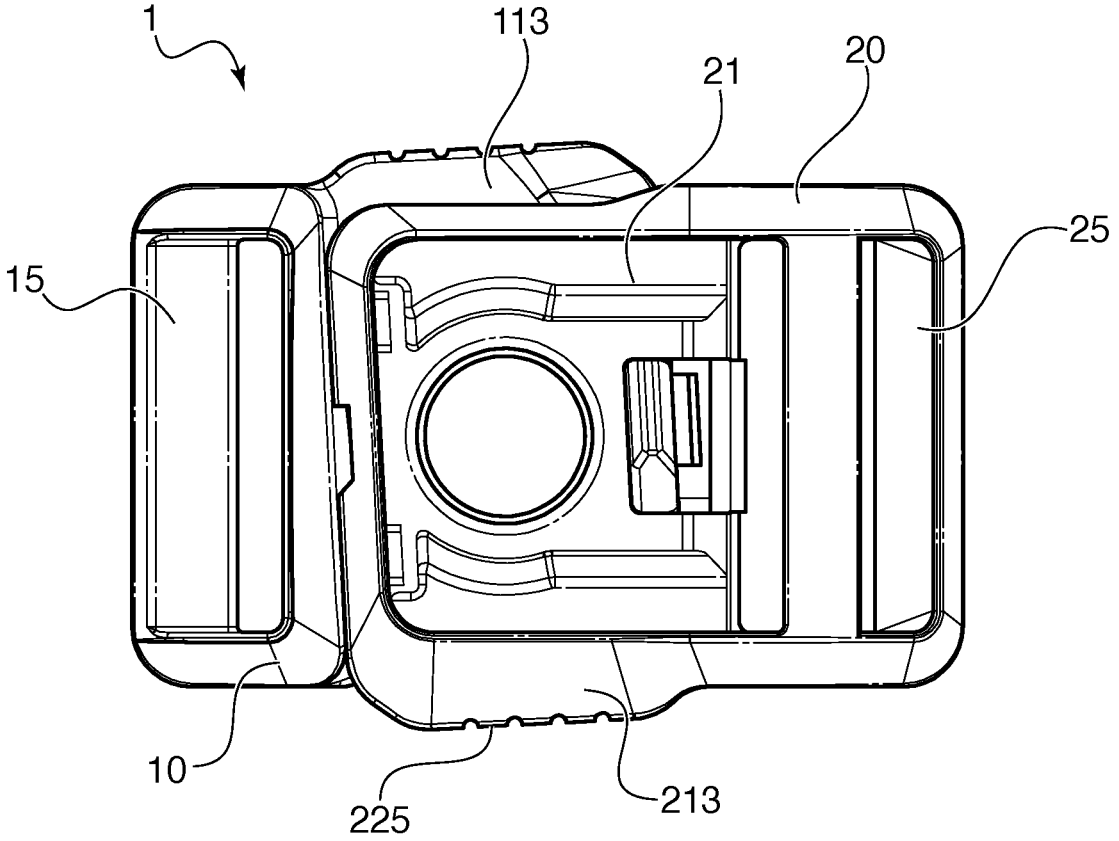
FIG. 1 shows a bottom view of the buckle assembly according to the invention.
Figure 2:
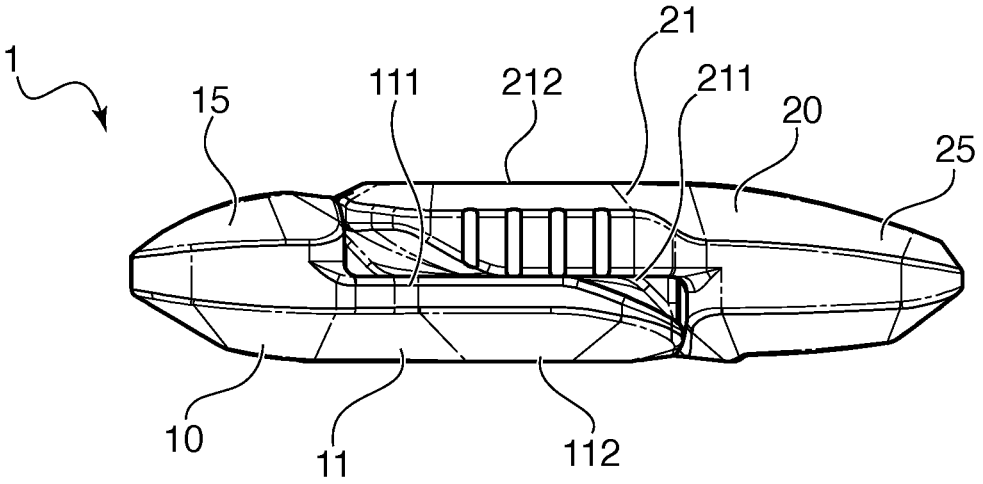
FIG. 2 shows a side view of the buckle assembly.
Figure 3:
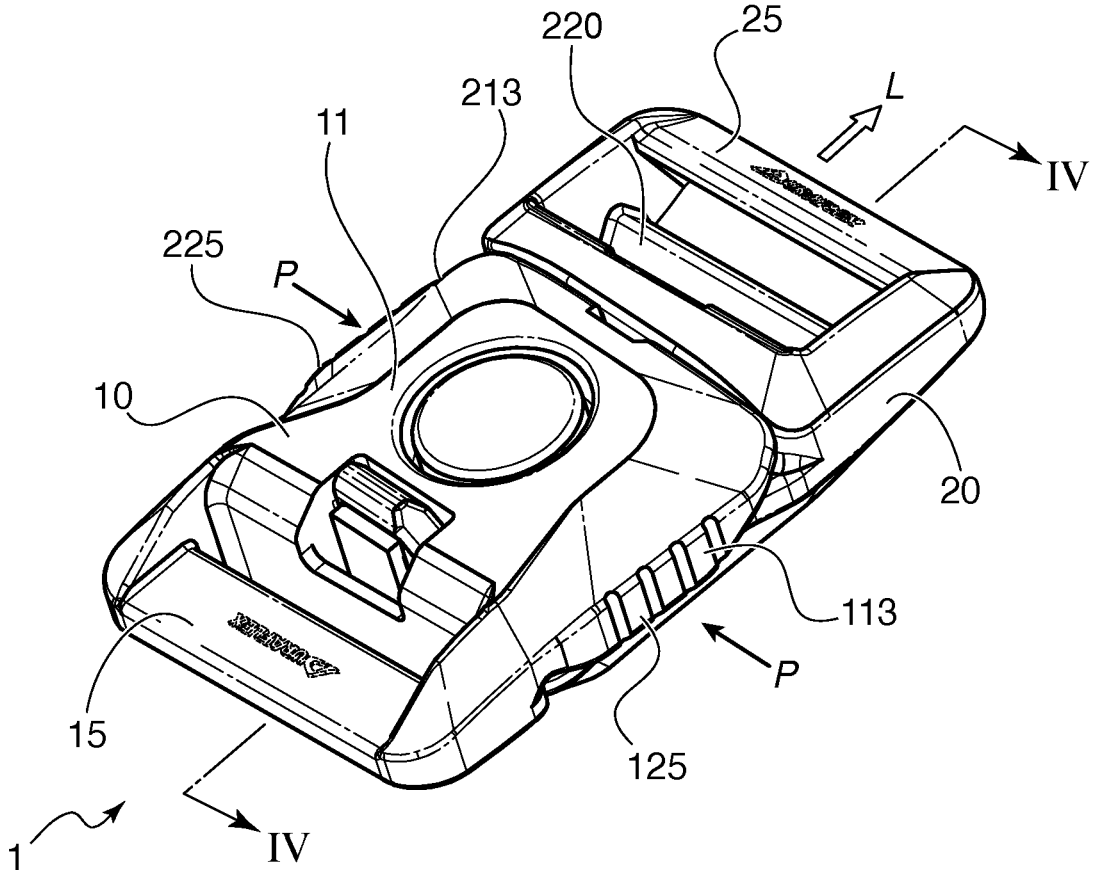
FIG. 3 shows a top and side perspective view of the buckle assembly.

Referring now in detail to the drawings, FIGS. 1-4 show the buckle assembly 10 according to the invention. Buckle assembly 1 comprises a first buckle portion 10 and a second buckle portion 20. Buckle portion 10 has a buckle body 11, having an exterior surface 112 and an interior surface 111. Buckle portion 20 has a buckle body 21 with an exterior surface 212 and an interior surface 211. On their respective outer edges, which extend beyond the overlapping portions of buckle bodies 11, 21, are strap retaining bars 15, 25, respectively. An additional strap retaining bar 220 is also present on buckle portion 20, to allow for adjustability of a strap connected thereto. An additional bar could also be present on buckle portion 10 if desired. Side edge 113 of buckle portion 10 extends beyond the overlapping portions of buckle bodies 11, 21, and side edge 213 of buckle portion 20 extends beyond the overlapping portions of buckle bodies 12, 21 on the opposite side.

The individual buckle portions 10, 20 are shown in detail in FIGS. 5-12. Both buckle portions can be constructed to be identical or can be made to differ in appearance and/or structure, as long as their cooperating features are intact.

Figure 5:
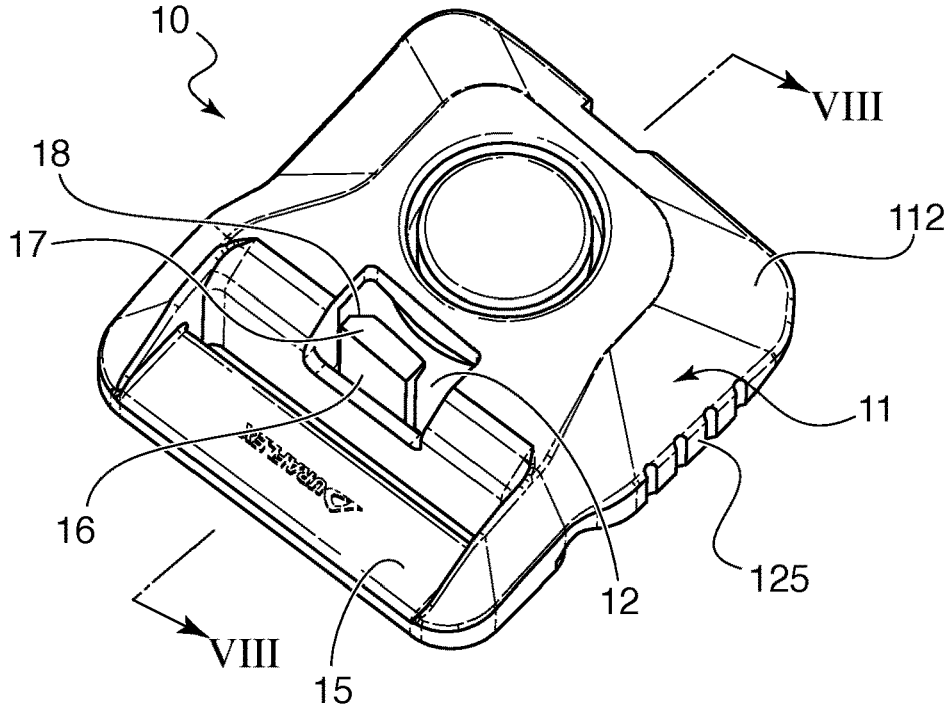
FIG. 5 shows a top view of a first buckle portion according to the invention.
Figure 6:
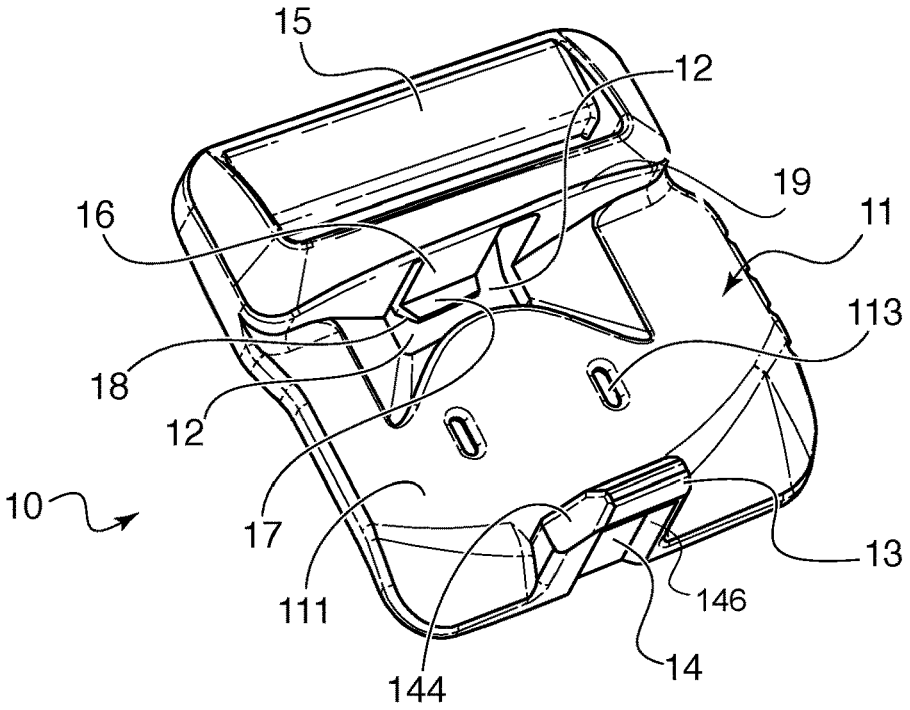
FIG. 6 shows a bottom view of the first buckle portion.
Figure 7:
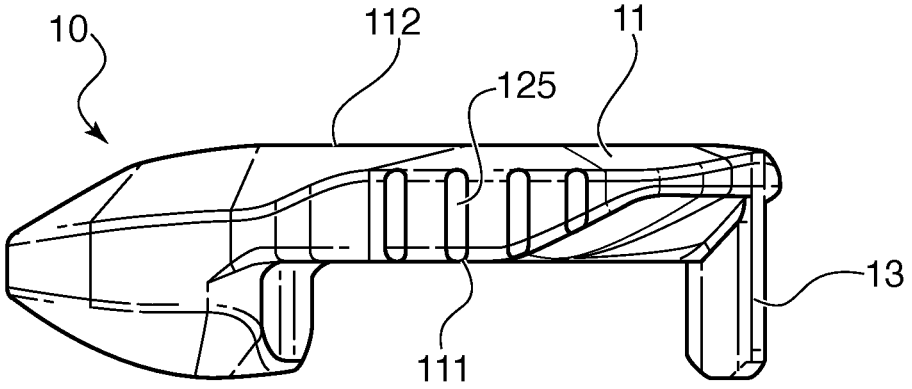
FIG. 7 shows a side view of the first buckle portion.
Figure 8:
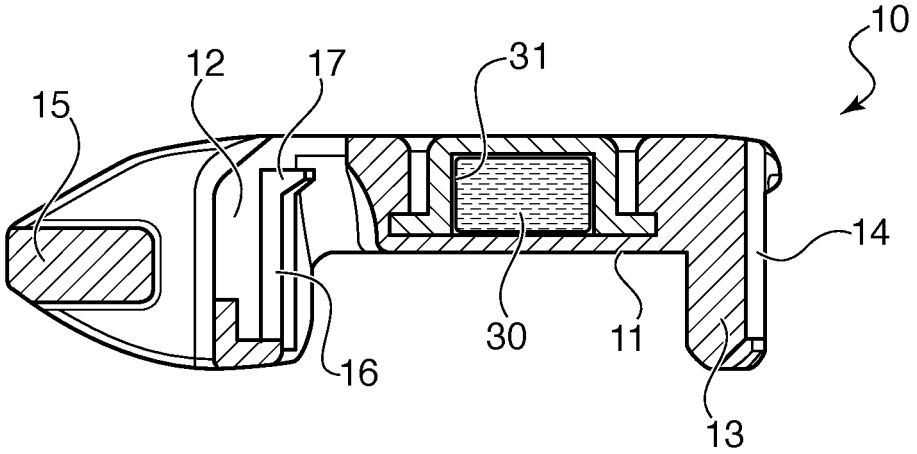
FIG. 8 shows a cross-sectional view along lines VIII-VIII of FIG. 5.

FIGS. 5-8 show buckle portion 10 in its unassembled state. As shown in FIG. 6, interior surface 111 has a recess12 with a guide surface 19, as well as a fastening tenon 16, which is connected to buckle body 11 at a top end and which extends down into recess 12, ending in a free end 17 that extends horizontally. Fastening tenon 16 is constructed so that it can flex upon the application of pressure. Free end 17 has a bevel 18 on one edge. On the opposite side of buckle body 11 is a fastening hook 13, which extends upward from interior surface 111. Fastening hook 13 has a notch 14 in its outwardly facing side. Fastening hook 13 can also have a bevel 144 on one corner. Notch 14 has at least one slanted side wall 146. As shown in FIG. 8, a magnet 30 is disposed in a cavity 31 of buckle portion 10 and is covered by interior surface 111, which contains slots 113 (FIG. 6). As shown in FIG. 5, recess 12 extends entirely through exterior surface 112 so that fastening tenon 16 is visible from exterior surface 112 of buckle portion 10.

Figure 9:
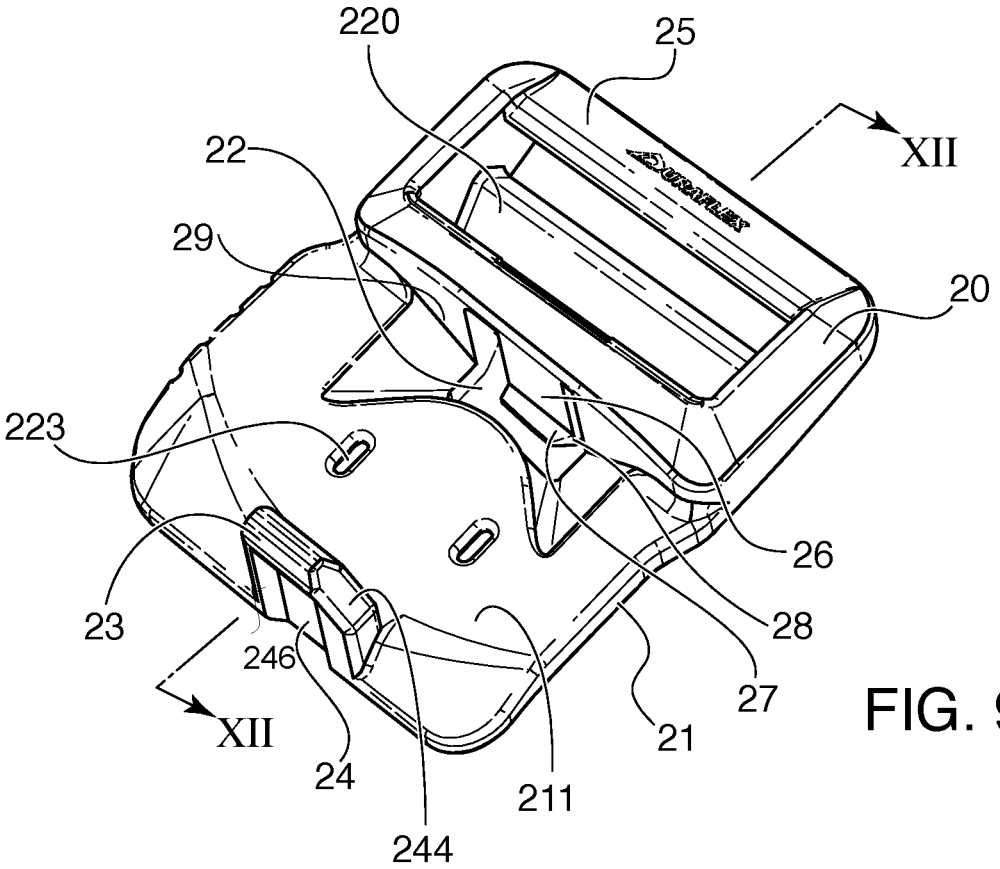
FIG. 9 shows a top view of the second buckle portion.
Figure 10:
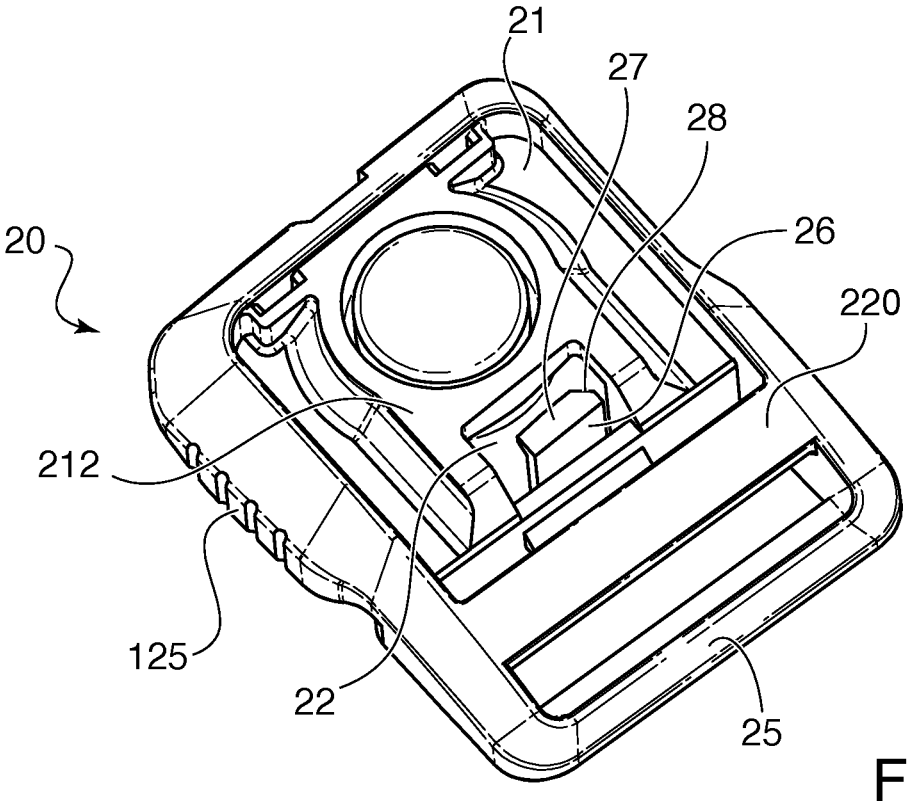
FIG. 10 shows a bottom view of the second buckle portion.
Figure 11:
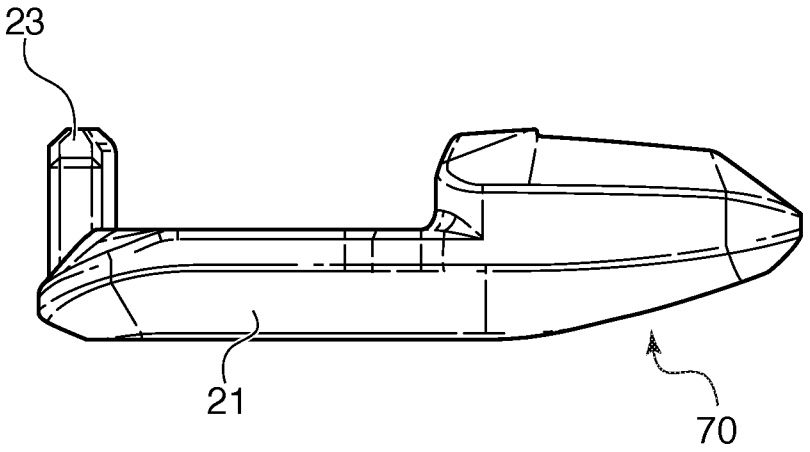
FIG. 11 shows a side view of the second buckle portion.
Figure 12:
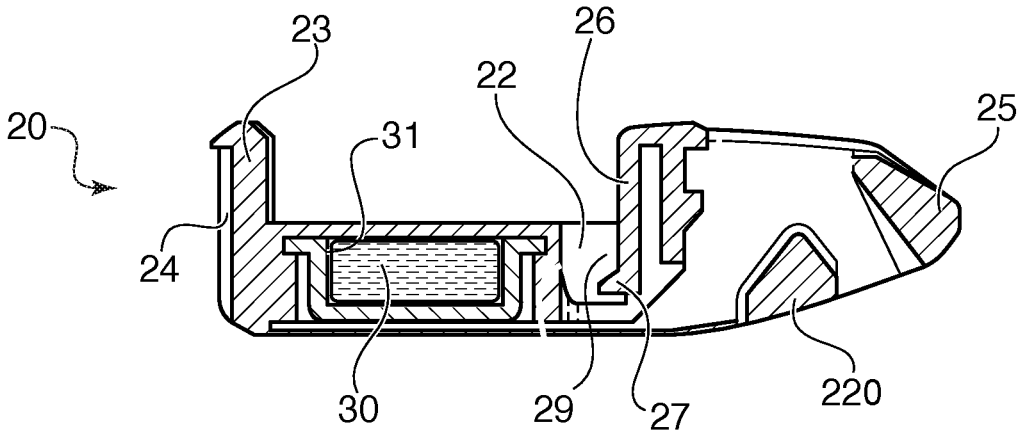
FIG. 12 shows a cross-sectional view along lines XII-XII of FIG. 9.

FIGS. 9-12 show buckle portion 20 in its unassembled state. As shown in FIG. 9, interior surface 211 has a recess 22 with a guide surface 29, as well as a fastening tenon 26, which is connected to buckle body 21 at a top end and which extends down into recess 22, ending in a free end 27 that extends horizontally. Free end 27 has a bevel 28 on one edge. Fastening tenon 26 is constructed so that it can flex upon the application of pressure. On the opposite side of buckle body 21 is a fastening hook 23, which extends upward from interior surface 211. Fastening hook 23 has a notch 24 in its outwardly facing side. Fastening hook 23 can also have a bevel 244 on one corner. Notch 44 has at least one slanted side wall 246. As shown in FIG. 12, a magnet 30 is disposed in a cavity 31 of buckle portion 20 and is covered by interior surface 211, which contains slots 223 (FIG. 9). As shown in FIG. 10, recess 22 extends entirely through exterior surface 212 so that fastening tenon 26 is visible from exterior surface 212 of buckle portion 20.

Figure 4:
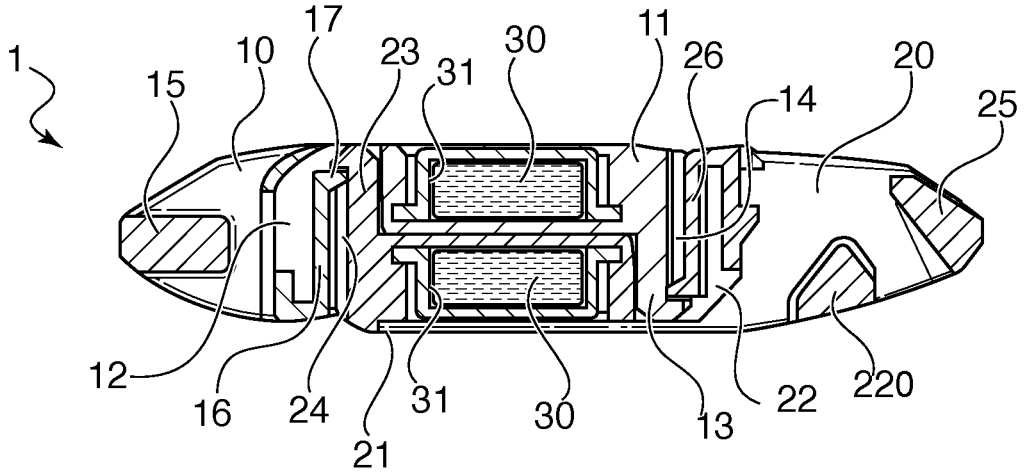
FIG. 4 shows a cross-sectional view along lines VI-VI of FIG. 3.

The operation of buckle assembly 10 is described as follows with particular reference to FIG. 4: To assemble buckle portion 10 and buckle portion 20, the two buckle portions are placed together with their interior surfaces 111, 211 facing each other and the strap retaining bars 15, 25 on opposite ends. The attractive force of the magnets 30 on each of the buckle portions 10, 20 draws the buckle portions 10, 20 together so that fastening hook 13 extends into recess 22 and engages fastening tenon 26 with free end 27 extending into notch 14. The spring force of fastening tenon 26 against fastening hook 13 keeps fastening hook 13 firmly in place in recess 22 against guide surface 29. Similarly, on the other side, that fastening hook 23 extends into recess 12 and engages fastening tenon 16 with free end 17 extending into notch 24. The spring force of fastening tenon 16 against fastening hook 23 keeps fastening hook 23 firmly in place in recess 12 against guide surface 19. The secure engagement of the fastening hooks 13, 23 in the recesses 22, 12, respectively prevents disengagement of the buckle portions 10, 20 when force is applied in the longitudinal direction L, such as by tension on straps (not shown) connected to bars 15, 25. The buckle is also firmly secured even when force is applied in the perpendicular direction, i.e, perpendicular to the inner surfaces of the buckle portions.

To disengage the buckle portions 10, 20, the user presses inward simultaneously on the side edges 113, 213 of buckle portions 10, 20, in the area of finger grips 125, 225, respectively, in the direction of arrows P, which run perpendicular to the longitudinal direction L in the horizontal direction. This makes buckle portions 10, 20, slide laterally relative to each other, toward the center of the buckle assembly. As the buckle portions slide laterally, the locking hooks 13, 23 of each buckle portion also slides laterally along guide surfaces 29, 19, until they pass the bevels 28, 18 of fastening tenons 26, 16, respectively. The slanted side walls 146, 246 of notches 14, 24 allow fastening hooks 13, 23 to more easily disengage from fastening tenons 16, 16, respectively. The flex in the fastening tenons allows them to bend while moving out of engagement with the fastening hooks as they slide along the slanted side walls 146, 246 of notches 14, 24. In addition, the lateral sliding has broken the attraction between the two magnets 30, and the two buckle portions 10, 20 can easily be released from each other.

The present invention provides a simple and secure way to attach two buckle parts together, without requiring a large amount of force to disengage the parts. Accordingly, while only a few embodiments of the present invention have been shown and described, it is obvious that many changes and modifications may be made thereunto without departing from the spirit and scope of the invention.

What is claimed is:

1. A buckle assembly comprising:

a first buckle portion comprising a buckle body with an exterior surface, and interior surface, a fastening hook on one longitudinal end and a fastening recess on another longitudinal end, and a magnet connected to the interior surface; and a second buckle portion comprising a buckle body with an exterior surface, an interior surface, a fastening hook on one longitudinal end and a fastening recess on another longitudinal end, and a magnet connected to the interior surface, wherein the buckle portions are configured such that placing the interior surface of the first buckle portion against the interior surface of the second buckle portion causes the magnets to engage each other and the fastening hook each buckle portion to enter the fastening recess of the other buckle portion, to lock the two buckle portions together and prevent disengagement under tension in opposing directions parallel to a longitudinal extent of the buckle assembly, and wherein the buckle portions are configured to be disengaged from each other by pressing the buckle portions in opposing directions that run transverse to the longitudinal extent of the buckle assembly until the magnets disengage from each other, and further comprising a fastening tenon connected to the buckle body and extending into the fastening recess on each of the first and second buckle portions, wherein the fastening hooks engage a respective one of the fastening tenons as the fastening hooks enter the fastening recesses to lock the two buckle portions together, and wherein the fastening recesses extend entirely though the buckle bodies of the first and second buckle portions, so that the fastening tenons are visible from the exterior surfaces of each of the first and second buckle portions.

2. The buckle assembly according to claim 1, wherein the fastening hooks have a notch in an end portion thereof, such that an end of each tenon engages into the notch in a corresponding one of the fastening hooks when the two buckle portions are connected together.

3. The buckle assembly according to claim 2, wherein the ends of the tenons each have a bevel along one side thereof, wherein the bevel slides along the notch when the buckle portions are pressed in opposing directions transverse to the longitudinal direction, until the fastening tenon exits the notch to release the buckle portions from each other.

4. The buckle assembly according to claim 2, wherein each notch has at least one outwardly extending side wall, such that the outwardly extending side wall slides past the fastening tenon during disengagement of the buckle portions from each other.

5. The buckle assembly according to claim 1, wherein each of the first and second buckle portions have at least one strap-retaining bar connected to the base body at the end having the fastening recess.

6. The buckle assembly according to claim 1, wherein a lateral edge of the first buckle portion extends beyond a lateral edge of the second buckle portion, and wherein an opposite lateral edge of the second buckle portion extends beyond an opposite lateral edge of the first buckle portion, when the two buckle portions are connected together.

7. The buckle assembly according to claim 6, further comprising a plurality of finger grips on the lateral edge of the first buckle portion and the opposite lateral edge of the second buckle portion.

8. The buckle assembly according to claim 1, wherein each of the fastening recesses on the first and second buckle portions are bordered by a guide surface configured for guiding the fastening hooks out of engagement with the fastening tenons during disengagement of the first and second buckle portions.

* * * * *